US007160089B2

(12) United States Patent
Hong et al.

(10) Patent No.: US 7,160,089 B2
(45) Date of Patent: Jan. 9, 2007

(54) ECCENTRIC COUPLING DEVICE IN RADIAL COMPLIANCE SCROLL COMPRESSOR

(75) Inventors: Sog-Kie Hong, Seoul (KR); Song Choi, Seoul (KR); Hong-Hee Park, Changwon-Si (KR); Nam-Kyu Cho, Seongnam-Si (KR)

(73) Assignee: LG Electronics Inc., Seoul (KR)

( * ) Notice: Subject to any disclaimer, the term of this patent is extended or adjusted under 35 U.S.C. 154(b) by 212 days.

(21) Appl. No.: 10/893,941

(22) Filed: Jul. 20, 2004

(65) Prior Publication Data

US 2005/0129555 A1 Jun. 16, 2005

(30) Foreign Application Priority Data

Dec. 16, 2003 (KR) ..... 10-2003-0091942

(51) Int. Cl.
*F01C 1/02* (2006.01)

(52) U.S. Cl. ..... 418/55.6; 418/55.1

(58) Field of Classification Search ..... 418/55.1, 418/55.5, 55.6

See application file for complete search history.

(56) References Cited

U.S. PATENT DOCUMENTS 5,713,731 A * 2/1998 Utter et al. ..... 418/55.5
5,810,573 A * 9/1998 Mitsunaga et al. ..... 418/55.6
6,053,714 A 4/2000 Fenocchi et al.
6,267,573 B1 7/2001 Fenocchi et al.
6,361,296 B1 3/2002 Hirooka et al.
6,461,131 B1 * 10/2002 Chang ..... 418/55.5

FOREIGN PATENT DOCUMENTS

JP 11-159484 6/1999

OTHER PUBLICATIONS

English Language Abstract of JP 11-159484.

* cited by examiner

*Primary Examiner*—Hoang Nguyen
(74) *Attorney, Agent, or Firm*—Greenblum & Bernstein, P.L.C.

(57) ABSTRACT

An eccentric coupling device in a radial compliance scroll compressor including a bush rotatably fitted in a boss of an orbiting scroll, and provided with a crank pin hole extending vertically throughout the bush, a crank pin eccentrically arranged at an upper end of a crankshaft adapted to orbit the orbiting scroll, and fitted in the crank pin hole while allowing a radial movement of the bush in the crank pin hole, the crank pin having an oil passage, and a cover member fitted in the crank pin hole at an upper end portion of the crank pin hole, and adapted to guide oil, fed through the oil passage, to be supplied between the slide bush and the boss. The crank pin is fitted in the crank pin hole such that an upper end thereof is arranged at a level lower than an upper end of the slide bush. The crank pin is eccentrically arranged with respect to the crankshaft. The oil passage communicates with an oil passage extending through the crankshaft.

12 Claims, 8 Drawing Sheets

ECCENTRIC COUPLING DEVICE IN RADIAL COMPLIANCE SCROLL COMPRESSOR

BACKGROUND OF THE INVENTION

1. Field of the Invention

The present invention relates to a slide bush of a scroll compressor, and more particularly to an eccentric coupling device in a radial compliance scroll compressor, which is capable of sufficiently supplying oil, fed through an oil passage of a crankshaft, between a slide bush and a bearing to lubricate frictional surfaces thereof.

2. Description of the Related Art

Generally, a scroll compressor includes upper and lower scrolls respectively provided with involute-shaped wraps engaged with each other. One of the scrolls performs an orbiting motion with respect to the other scroll to reduce the volume of spaces defined between the scrolls, thereby compressing gas confined in the spaces.

As such a conventional compressor, a radial compliance scroll compressor is known. In such a radial compliance scroll compressor, an orbiting scroll thereof is backwardly moved when liquid refrigerant, oil or foreign matter is introduced into compression chambers defined between the orbiting scroll and the other scroll, that is, a fixed scroll, thereby abnormally increasing the gas pressure in the compression chambers. In accordance with the backward movement of the orbiting scroll, it is possible to prevent the wraps of the scrolls from being damaged due to the abnormally increased gas pressure.

FIG. 1 is a sectional view illustrating the entire configuration of a conventional radial compliance scroll compressor.

As shown in FIG. 1, the conventional radial compliance scroll compressor includes a shell 1, and main and sub frames 2 and 3 respectively arranged in the shell 1 at upper and lower portions of the shell 1. A stator 4, which has a hollow structure, is interposed between the main and sub frames 2 and 3 within the shell 1.

A rotor 5 is arranged inside the stator 4 such that it rotates when current flows through the stator 4. A vertical crankshaft 6 extends axially through a central portion of the rotor 5 while being fixed to the rotor 5 so that it is rotated along with the rotor 5. The crankshaft 6 has upper and lower ends protruded beyond the rotor 5, and rotatably fitted in the main and sub frames 2 and 3, respectively. Thus, the crankshaft 6 is rotatably supported by the main and sub frames 2 and 3.

An orbiting scroll 7 is mounted to an upper surface of the main frame 2 in the shell 1. The orbiting scroll 7 is coupled, at a lower portion thereof, with the upper end of the crankshaft 6, which is protruded through the main frame 2, so that it performs an orbiting motion in accordance with rotation of the crankshaft 6. The orbiting scroll 7 is provided, at an upper portion thereof, with an orbiting wrap 7*a* having an involute shape. The orbiting wrap 7*a* extends upwardly from an upper surface of the orbiting scroll 7. A fixed scroll 8 is arranged on the orbiting scroll 7 in the shell 1 while being fixed to the shell 1. The fixed scroll 8 is provided, at a lower portion thereof, with a fixed wrap 8*a* adapted to be engaged with the orbiting wrap 7*a* of the orbiting scroll 7 such that compression chambers 22 are defined between the wraps 7*a* and 8*a*.

With this configuration, when the orbiting scroll 7 performs an orbiting motion in accordance with rotation of the crankshaft 6, gaseous refrigerant is introduced into the compression chambers 22 in a sequential fashion, so that it is compressed.

For the orbiting motion thereof, the orbiting scroll 7 is eccentrically coupled to the crankshaft 6. For this eccentric coupling, the crankshaft 6 is provided with a crank pin 10 upwardly protruded from the upper end of the crankshaft 6 at a position radially spaced apart from the center of the upper end of the crankshaft 6 by a certain distance. Also, the orbiting scroll 7 is provided, at the lower portion thereof, with a boss 7*b* centrally protruded from a lower surface of the orbiting scroll 7.

A bearing 11 is forcibly fitted in the boss 7*b*. Also, a slide bush 12 is slidably fitted around the crank pin 10. Thus, the crank pin 10 of the crankshaft 6 is rotatably received in the boss 7*b* of the orbiting scroll 7 via the bearing 11 and slide bush 12, so that the orbiting scroll 7 is eccentrically coupled to the crankshaft 6.

As a rotation preventing mechanism for the orbiting scroll 7, an Oldham ring 9 is arranged between the main frame 2 and the orbiting scroll 7. An oil passage 6*a* extends vertically throughout the crankshaft 6. Upper and lower balance weight members are provided at upper and lower surfaces of the rotor 5, respectively, in order to prevent a rotation unbalance of the crankshaft 6 caused by the crank pin 10.

In FIG. 1, reference numerals 15 and 16 designate suction and discharge pipes, respectively, reference numerals 17 and 18 designate a discharge port and a discharge chamber, respectively, reference numeral 19 designates a check valve, reference numeral 20 designates oil, and reference numeral 21 designates an oil propeller.

When current flows through the stator 4, the rotor 5 is rotated inside the stator 4, thereby causing the crankshaft 6 to rotate. In accordance with the rotation of the crankshaft 6, the orbiting scroll 7 coupled to the crank pin 10 of the crankshaft 6 performs an orbiting motion with an orbiting radius defined between the center of the crankshaft 6 and the center of the orbiting scroll 7.

In accordance with a continued orbiting motion of the orbiting scroll 7, the compression chambers 22, which are defined between the orbiting wrap 7*a* and the fixed wrap 8*a*, are gradually reduced in volume, so that gaseous refrigerant sucked into each compression chamber 22 via the suction pipe 15 is compressed to high pressure. The compressed high-pressure gaseous refrigerant is subsequently discharged into the discharge chamber 18 via the discharge port 17. The compressed high-pressure gaseous refrigerant is then outwardly discharged from the discharge chamber 18 via the discharge pipe 16.

FIG. 2 is an exploded perspective view illustrating the structure of the conventional slide bush.

As shown in FIG. 2, the slide bush 12 is fitted in the boss 7*b* of the orbiting scroll 7. The slide bush 12 is provided with a crank pin hole 12*a* so that it is fitted around the crank pin 10. In accordance with this arrangement, the slide bush 12 is radially shifted in a backward direction when an abnormal compression operation is carried out to cause an abnormal increase in the gas pressure of the compression chambers, thereby causing the orbiting scroll 7 to be radially shifted in the backward direction such that the orbiting wrap 7*a* is moved away from the fixed wrap 8*a*. An oil supply groove 12*b* is provided at an outer peripheral portion of the slide bush 12 at one side of the slide bush 12. The oil supply groove 12*b* may be formed by cutting out a desired peripheral portion of the slide bush 12.

FIGS. 3*a* to 3*c* illustrate a radial backward movement of the conventional slide bush. FIG. 3*a* is a cross-sectional view illustrating a state of the slide bush in a normal operation of the scroll compressor. FIG. 3*b* is a cross-sectional view illustrating a backwardly moved state of the slide bush caused by an abnormal operation of the scroll compressor. FIG. 3*c* is a sectional view illustrating supply of oil in the normal operation of the scroll compressor.

As shown in FIGS. 3*a* to 3*c*, in the normal operation of the scroll compressor, the crank pin 10 performs an orbiting motion along with the slide bush 12 in accordance with rotation of the crankshaft 6. When the gas pressure in the compression chambers is abnormally increased due to introduction of liquid refrigerant, oil or foreign matter into compression chambers during the normal operation of the scroll compressor, the slide bush 12 is radially shifted in a backward direction along the crank pin hole 12*a* with respect to the crank pin 10 in response to the increased gas pressure.

Meanwhile, oil 20 is supplied to the eccentric coupling device via the oil passage 6a formed through the crankshaft 6 during the normal operation of the scroll compressor. As the orbiting scroll 7 performs an orbiting motion, the oil 20 supplied to the eccentric coupling device is discharged from an upper end of the crank pin 10, so that it lubricates the bearing 11 and slide bush 12 fitted in the boss 7*b* of the orbiting scroll 7 while being in frictional contact with each other, thereby reducing friction generated between the bearing 11 and the slide bush 12. The oil 20 also serves to cool the stator 4 and rotor 5.

However, when the slide bush 12 is radially moved in the backward direction along the crank pin hole 12*a* due to an abnormal increase in the gas pressure of the compression chambers, the crank pin hole 12*a* is enlarged at one side of the slide bush 12, as shown in FIG. 3*b*. That is, the crank pin hole 12*a* has an enlarged gap at one side of the slide bush 12. As a result, the oil discharged from the upper end of the crank pin 10 via the oil passage 6*a* of the crankshaft 6 is mainly discharged through the enlarged gap of the crank pin hole 12*a* without being sufficiently supplied between the bearing 11 and the slide bush 12, that is, frictional surfaces thereof.

Due to such insufficient oil supply, a large frictional force is generated between the frictional surfaces, thereby causing the slide bush to be inclined at one side thereof. That is, a tilting phenomenon may occur.

Due to such a tilting phenomenon, the orbiting scroll cannot perform a smooth orbiting motion, thereby causing a degradation in the compression efficiency of the scroll compressor.

Furthermore, a large amount of frictional heat may be produced due to friction generated between the crank pin and the slide bush. The frictional heat may increase the temperature of the compression chambers, thereby causing a further degradation in the compression efficiency of the scroll compressor. The elements of the scroll compressor may also be damaged.

SUMMARY OF THE INVENTION

The present invention has been made in view of the above mentioned problems, and an object of the invention is to provide an eccentric coupling device in a radial compliance scroll compressor which is capable of sufficiently supplying oil, fed through an oil passage of a crankshaft, between a bush and a bearing to lubricate frictional surfaces thereof.

Another object of the invention is to provide an eccentric coupling device in a radial compliance scroll compressor which is capable of sufficiently supplying oil, fed through an oil passage of a crankshaft, between a bush and a bearing to lubricate frictional surfaces thereof, by use of a cover member, while preventing the cover member from being separated due to a tilting phenomenon caused by an abnormal increase in the gas pressure of compression chambers defined in the scroll compressor.

Another object of the invention is to provide an eccentric coupling device in a radial compliance scroll compressor which is capable of allowing convenient and simple manufacture of a bush thereof.

In accordance with a first aspect, the present invention provides a radial compliance scroll compressor comprising: a bush rotatably fitted in an inner surface of a boss of an orbiting scroll, and provided with a crank pin hole extending vertically throughout the bush; a crank pin eccentrically arranged at an upper end of a crankshaft adapted to orbit the orbiting scroll, and fitted in the crank pin hole while allowing a movement of the bush in the crank pin hole, the crank pin having an oil passage communicating with an oil passage formed through the crankshaft; and a cover member fitted in an upper end portion of the crank pin hole, and adapted to guide oil fed through the oil passage of the crank pin such that the oil is supplied between an outer peripheral surface of the bush and an inner peripheral surface of the boss.

In the radial compliance scroll compressor according to the first aspect of the present invention, the crank pin is fitted in the crank pin hole such that an upper end thereof is arranged at a level lower than an upper end of the bush.

In the radial compliance scroll compressor according to the first aspect of the present invention, it is possible to prevent oil, fed through the oil passage of the crank pin, from flowing a gap defined between the crank pin and the crank pin hole, thereby allowing the oil to be sufficiently supplied between the bush and a bearing fitted in the boss, that is, frictional surfaces thereof.

In the radial compliance scroll compressor according to the first aspect of the present invention, the cover member may comprise a body plate tightly fitted in the crank pin hole over the crank pin, and an oil hole formed through the body plate at a position corresponding to the oil passage of the crank pin. In accordance with this configuration, it is possible to simply manufacture the cover member. It is also possible to prevent oil from flowing the gap defined between the crank pin and the crank pin hole, while allowing the oil to be sufficiently supplied between the bush and a bearing fitted in the boss.

In the radial compliance scroll compressor according to the first aspect of the present invention, the body plate may have a thickness equal to a height from an upper end of the crank pin to an upper end of the bush so that the body plate is in close surface contact with the upper end of the crank pin at a lower surface thereof. By virtue of the body plate, it is possible to minimize an amount of oil discharged at an upper end of the crank pin, and thus, to sufficiently supply oil to an upper surface of the body plate.

In the radial compliance scroll compressor according to the first aspect of the present invention, the oil hole may have a diameter larger than a diameter of the oil passage of the crank pin. Accordingly, oil emerging from the oil passage can rapidly pass through the oil hole, so that it can be rapidly supplied onto the upper surface of the body plate without a reduction in the flow rate thereof caused by the oil hole.

In accordance with a second aspect, the present invention provides a radial compliance scroll compressor comprising: a bush rotatably fitted in an inner surface of a boss of an orbiting scroll, and provided with a crank pin hole extending vertically throughout the bush; a crank pin eccentrically arranged at an upper end of a crankshaft adapted to orbit the orbiting scroll, and fitted in the crank pin hole while allowing a radial movement of the bush in the crank pin hole, the crank pin having an oil passage communicating with an oil passage formed through the crankshaft; a cover member fitted in an upper end portion of the crank pin hole, and adapted to guide oil fed through the oil passage of the crank pin such that the oil is supplied between an outer peripheral surface of the bush and an inner peripheral surface of the boss; and a separation preventing member provided at an upper end of the crank pin hole, and adapted to prevent the cover member from being separated from the crank pin hole.

In the radial compliance scroll compressor according to the second aspect of the present invention, the crank pin is fitted in the crank pin hole such that an upper end thereof is arranged at a level lower than an upper end of the bush.

In the radial compliance scroll compressor according to the second aspect of the present invention, it is possible to sufficiently supply oil, fed through the oil passage of the crank pin, between the bush and a bearing fitted in the boss, that is, frictional surfaces thereof, while preventing the cover member from being separated due to a tilting phenomenon of the bush.

In the radial compliance scroll compressor according to the second aspect of the present invention, the separation preventing member may comprise a separation preventing jaw radially inwardly protruded from the upper end of the crank pin hole, and adapted to be in contact with the upper surface of the cover member. In accordance with this configuration, it is possible to simply implement the separation preventing member while reliably preventing the cover member from rising upwardly, thereby preventing the cover member from being separated from the crank pin hole.

In accordance with a third aspect, the present invention provides a radial compliance scroll compressor comprising: a bush rotatably fitted in an inner surface of a boss of an orbiting scroll, and provided with a crank pin hole extending vertically throughout the bush; a crank pin eccentrically arranged at an upper end of a crankshaft adapted to orbit the orbiting scroll, and fitted in the crank pin hole while allowing a radial movement of the bush in the crank pin hole, the crank pin having an oil passage communicating with an oil passage formed through the crankshaft; and a cover member provided at an upper end of the bush while being integral with the bush, and adapted to close an upper end of the crank pin hole, the cover member having an oil hole formed through the cover member at a position corresponding to the oil passage of the crank pin.

In the radial compliance scroll compressor according to the third aspect of the present invention, the crank pin is fitted in the crank pin hole such that an upper end thereof is arranged at a level lower than an upper end of the bush.

In the radial compliance scroll compressor according to the third aspect of the present invention, it is possible to conveniently and simply manufacture the cover member, while sufficiently supply oil, fed through the oil passage of the crank pin, between the bush and a bearing fitted in the boss, that is, frictional surfaces thereof, In the radial compliance scroll compressor according to the third aspect of the present invention, the cover member has a thickness equal to a height from an upper end of the crank pin to an upper end of the bush so that the cover member is in close surface contact with the upper end of the crank pin at a lower surface thereof. By virtue of the cover member, it is possible to minimize an amount of oil discharged at an upper end of the crank pin, and thus, to sufficiently supply oil to an upper surface of the body plate.

BRIEF DESCRIPTION OF THE DRAWINGS

The above objects, and other features and advantages of the present invention will become more apparent after reading the following detailed description when taken in conjunction with the drawings, in which.

DESCRIPTION OF THE PREFERRED EMBODIMENTS

Now, embodiments of an eccentric coupling device in a radial compliance scroll compressor according to the present invention will be described with reference to the annexed drawings.

Figure 1:
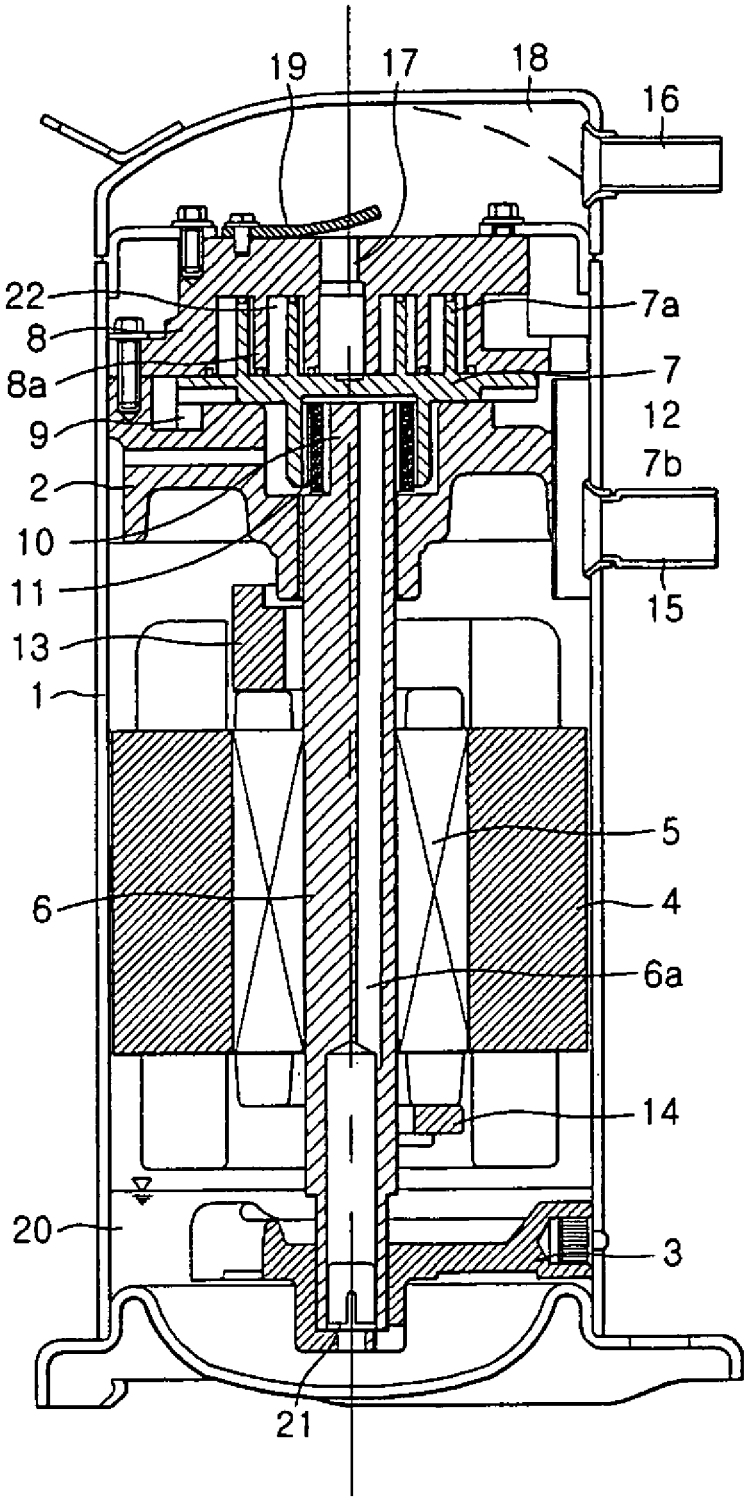
Fig.1 (Prior Art)
FIG. 1 is a sectional view illustrating the entire configuration of a conventional radial compliance scroll compressor.
Figure 2:
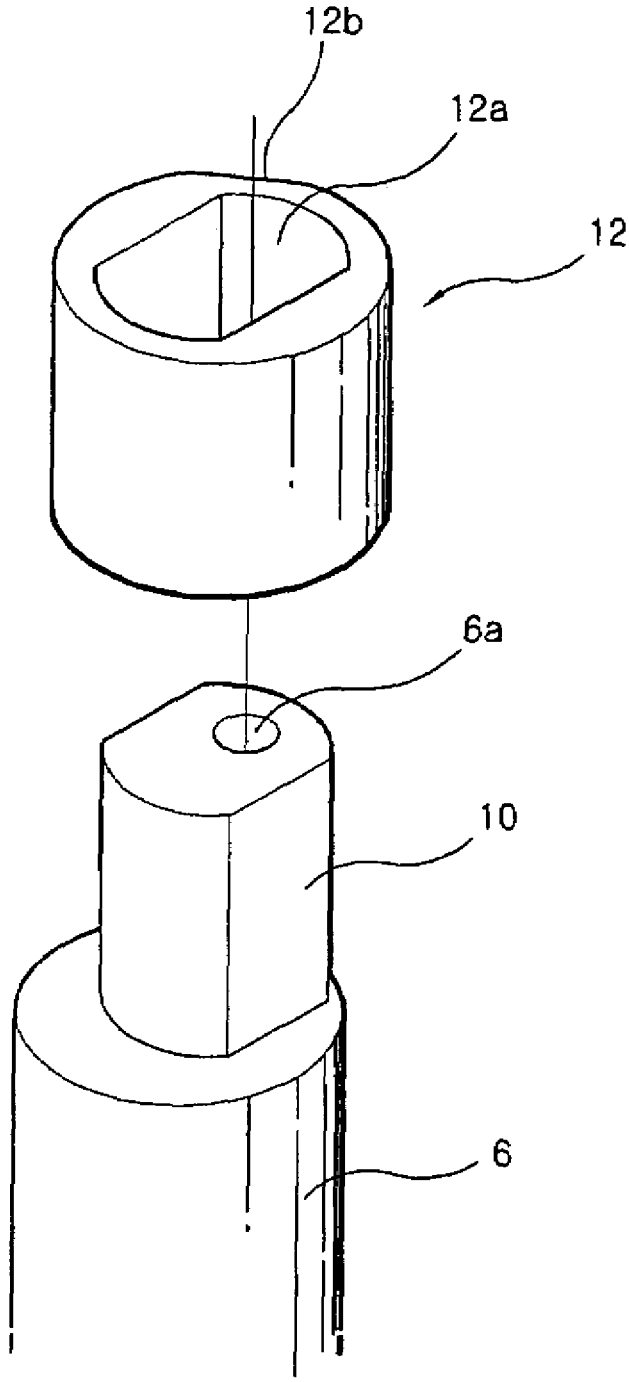
Fig.2 (Prior Art)
FIG. 2 is an exploded perspective view illustrating a structure of a conventional eccentric coupling device.
Figure 3A:
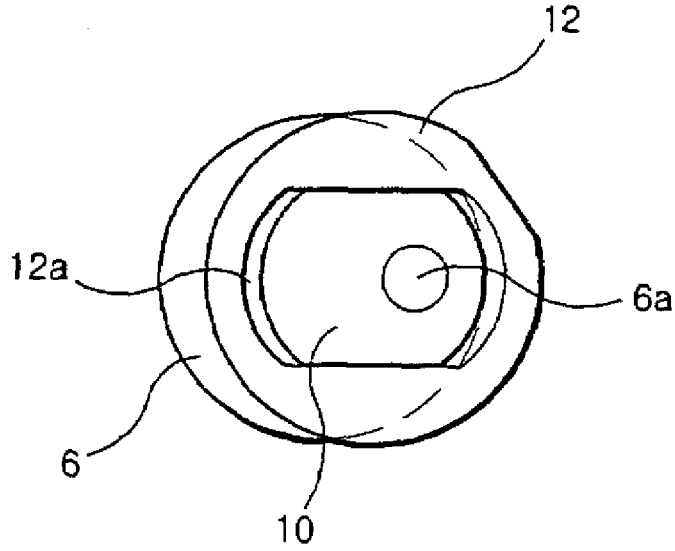
Fig.3a (Prior Art)
FIG. 3*a* is a cross-sectional view illustrating a state of a slide bush in a normal operation of the scroll compressor.
Figure 3B:
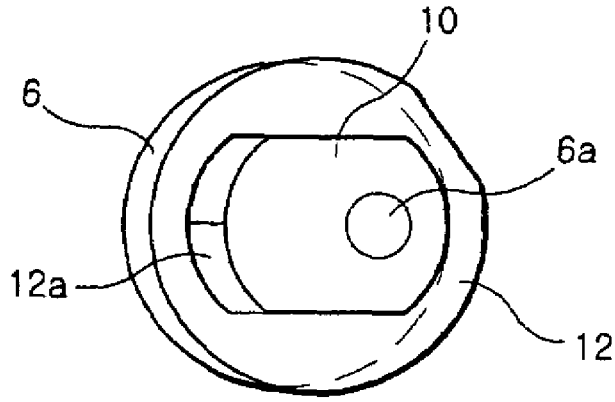
Fig.3b (Prior Art)
FIG. 3*b* is a cross-sectional view illustrating a backwardly moved state of the slide bush caused by an abnormal operation of the scroll compressor.
Figure 3C:
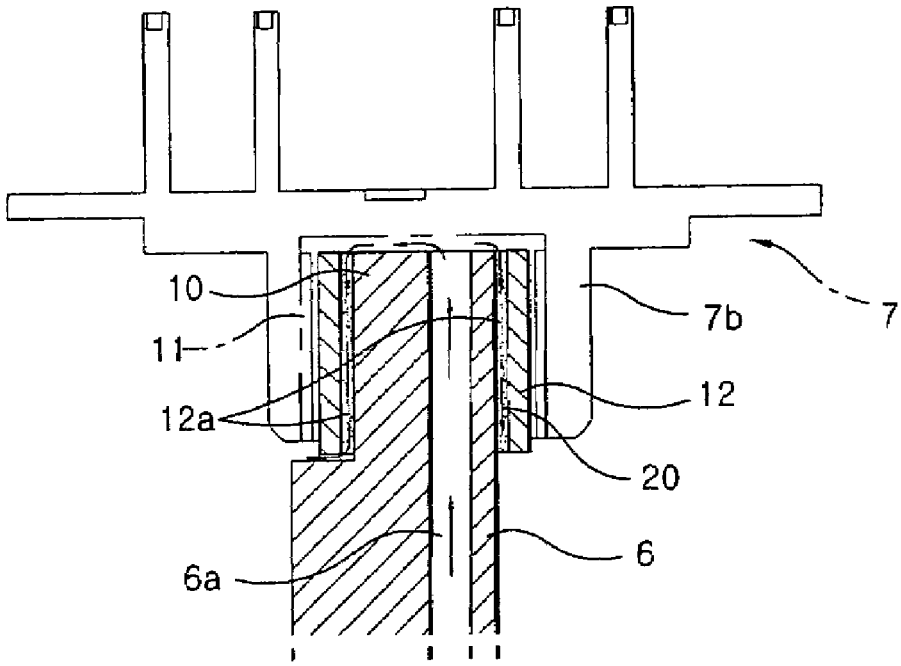
Fig.3c (Prior Art)
FIG. 3*c* is a sectional view illustrating supply of oil in the normal operation of the scroll compressor.
Figure 4:
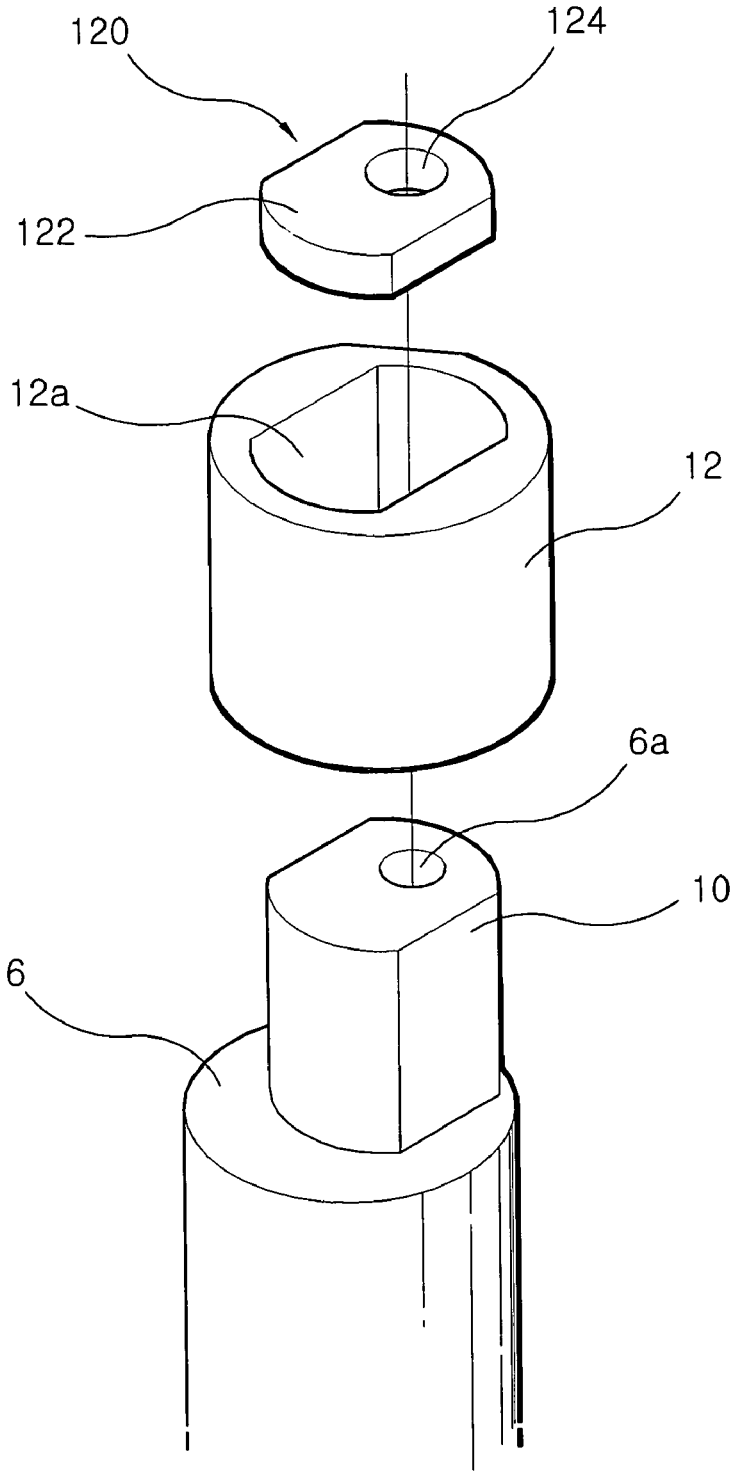
FIG. 4 is an exploded perspective view illustrating an eccentric coupling device according to an embodiment of the present invention.

FIG. 4 is an exploded perspective view illustrating an eccentric coupling device according to an embodiment of the present invention. The eccentric coupling device may be applied to the radial compliance scroll compressor shown in FIG. 1. In order to simplify the description thereof, the eccentric coupling device will be described in conjunction with the case in which it is applied to the radial compliance scroll compressor shown in FIG. 1. In FIG. 4, elements respectively corresponding to those in FIGS. 1 and 2 will be designated by the same reference numerals.

As shown in FIG. 4, the eccentric coupling device includes a slide bush 12 fitted in a bearing 11 (FIG. 6) fixedly fitted in a boss 7*b* of an orbiting scroll 7. The slide bush 12 is provided with a crank pin hole 12*a*. The eccentric coupling device also includes a crank pin 10 fitted in the crank pin hole 12*a* of the slide bush 12 such that it allows a radial movement of the slide bush 12 along the crank pin hole 12*a*. The crank pin 10 is provided with an oil passage 6*a*. The eccentric coupling device further includes a cover member 120 fitted in the crank pin hole 12*a* of the slide bush 12 at an upper end portion of the crank pin hole 12*a*, and adapted to guide oil, fed through the oil passage 6*a*, to be supplied between the bearing 11 and the slide bush 12.

The crank pin 10 has a length shorter than that of the slide bush 12 such that an upper end thereof is arranged at a level lower than an upper end of the slide bush 12 under the condition in which the slide bush 12 is fitted around the crank pin 10. With this structure, a space for receiving the cover member 120 is provided at the upper end portion of the crank pin hole 12*a*.

The crank pin 10 is provided at an upper end of the crankshaft 6 such that it is eccentrically arranged with respect to the crankshaft 6. The oil passage 6*a* is connected to an oil passage extending throughout the crankshaft 6. The oil passage of the crankshaft 6 is also denoted by the reference numeral "6*a*".

The cover member 120 includes a body plate 122 tightly fitted in the crank pin hole 12*a* over the crank pin 10, and an oil hole 124 formed through the body plate 122 at a position corresponding to the oil passage 6*a*.

The body plate 122 serves to guide oil, fed through the oil passage 6*a*, to an upper surface thereof through the oil hole 124, while cutting off discharge of the oil through a gap defined between the crank pin 10 and the crank pin hole 12*a*. In accordance with this function of the body plate 122, the oil discharged onto the upper surface of the body plate 122 ca smoothly flow along an outer peripheral surface of the slide bush 12, so that it can lubricate the frictional surfaces of the bearing 11 and slide bush 12.

The body plate 122 has a thickness equal to a height from the upper end of the crank pin 10 to the upper end of the slide bush 12. The body plate 122 is in close surface contact with the upper end of the crank pin 10 at a lower surface thereof. In accordance with the close surface contact of the body plate 122 with the crank pin 10, it is possible to cut off discharge of oil through the gap defined between the crank pin 10 and the crank pin hole 12*a*. Accordingly, it is possible to sufficiently supply oil onto the upper surface of the body plate 122.

The oil hole 124 has a diameter larger than that of the oil passage 6*a* so that oil emerging from the oil passage 6*a* rapidly passes through the oil hole 124. Accordingly, the oil can be rapidly supplied onto the upper surface of the body plate 122 without a reduction in the flow rate thereof caused by the oil hole 124.

Figure 5:
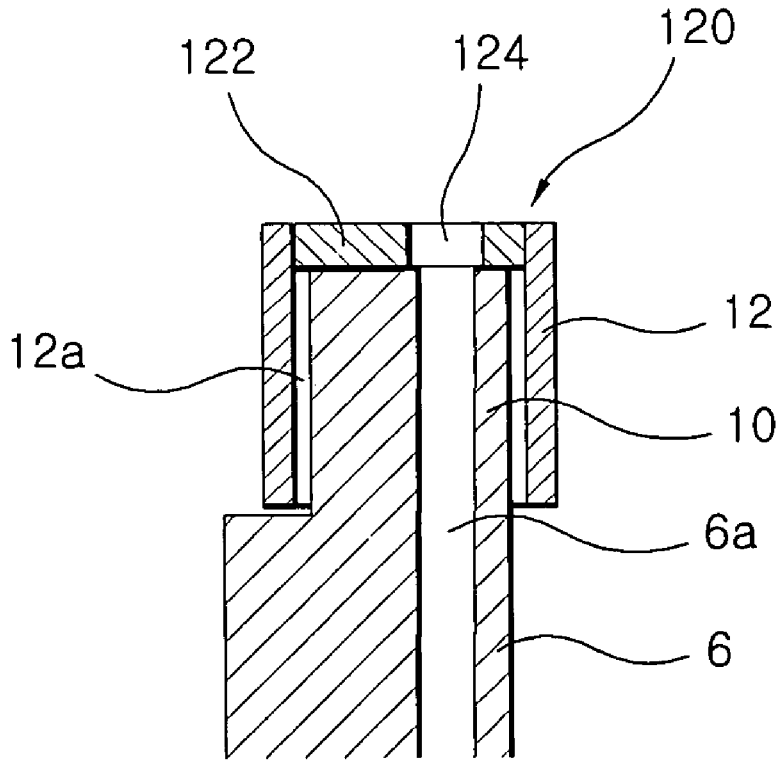
FIG. 5 is a sectional view illustrating an assembled state of the eccentric coupling device shown in FIG. 4.

FIG. 5 is a sectional view illustrating an assembled state of the eccentric coupling device shown in FIG. 4.

As shown in FIG. 5, the body plate 122 of the cover member 120 is tightly fitted in the crank pin hole 12*a* of the slide bush 12 such that the oil hole 124 is aligned with the oil passage 6*a* of the crank pin 10.

Preferably, the upper surface of the body plate 122 is flush with the upper end of the slide bush 12. The lower surface of the body plate 122 is in close contact with the upper end of the crank pin 10. Also, as described above, the diameter of the oil hole 124 is larger than the diameter of the oil passage 6*a*. The oil passage 6*a* extends through the crankshaft 6 and crank pin 10, and communicates with the oil hole 124.

Accordingly, oil fed through the oil passage 6*a* is discharged from the oil hole 124 onto the upper surface of the body plate 122, so that it flows horizontally along the upper surface of the body plate 122, and then flows downwardly along the outer peripheral surface of the slide bush 12.

Figure 6:
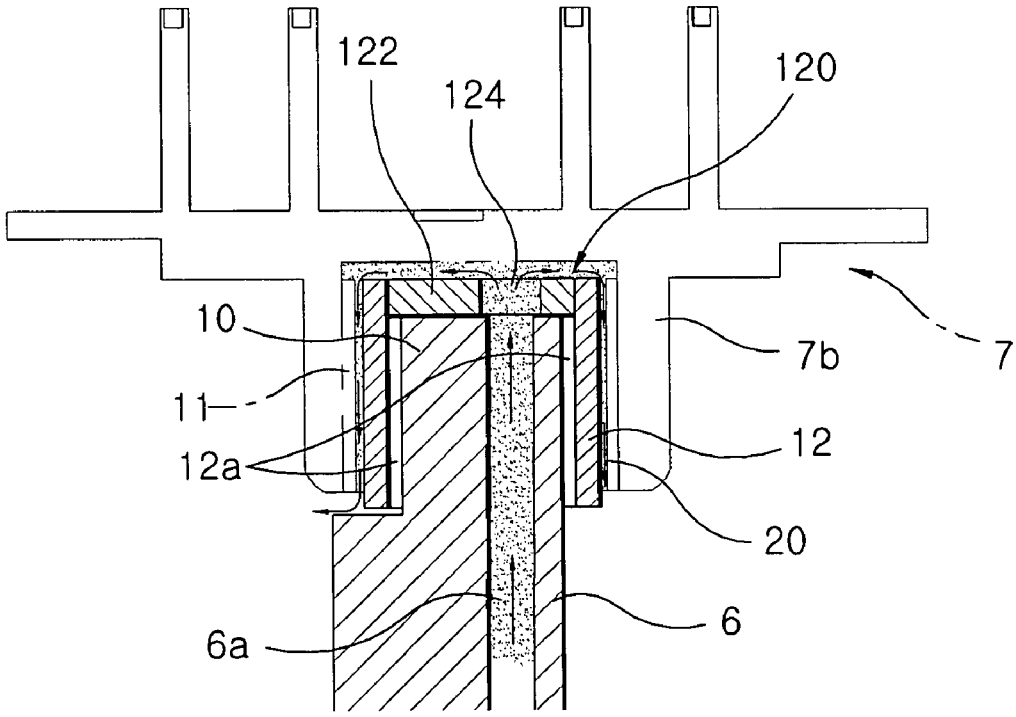
FIG. 6 is a sectional view illustrating a flow of oil along the slide bush in the eccentric coupling device shown in FIG. 4.

FIG. 6 is a sectional view illustrating a flow of oil along the slide bush in the eccentric coupling device shown in FIG. 4.

As shown in FIG. 6, the bearing 11 is tightly fitted in the boss 7*b* provided at the lower surface of the orbiting scroll 7. The slide bush 12 is rotatably fitted in the bearing 11.

The crank pin 10 of the crankshaft 6 is fitted in the crank pin hole 12*a* of the slide bush 12 such that the slide bush 12 is radially slidable therealong. The body plate 122 of the cover member 120 is tightly fitted in the crank pin hole 12*a* over the crank pin 10 such that it is in close contact with the upper end of the crank pin 10. Thus, the eccentric coupling device is completely assembled.

Oil is upwardly fed through the oil passage 6*a* during rotation of the crankshaft 6. The oil continuously passes through the oil hole 124 without being discharged through the gap defined between the crank pin 10 and the crank pin hole 12*a* in accordance with the function of the body plate 122. The oil is then discharged onto the upper surface of the body plate 122. Subsequently, the discharged oil flows horizontally along the upper surface of the body plate 122, and then flows downwardly between the inner peripheral surface of the bearing 11 and the outer peripheral surface of the slide bush 12, so that it is supplied between the bearing 11 and the slide bush 12.

The oil supplied between the bearing 11 and the slide bush 12 lubricates the frictional surfaces of the bearing 11 and slide bush 12, thereby reducing friction generated between the bearing 11 and the slide bush 12. Thus, damage to the bearing 11 and slide bush 12 caused by the friction is prevented.

In accordance with the reduction in the friction between the bearing 11 and the slide bush 12, the orbiting motion of the orbiting scroll 7 is smoothly carried out. Also, generation of frictional heat is prevented. Thus, the compression efficiency of the scroll compressor is improved.

Figure 7:
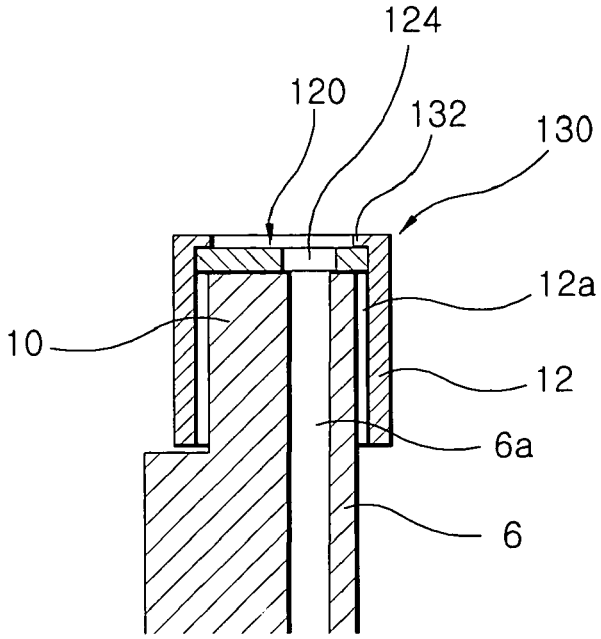
FIG. 7 is a sectional view illustrating an eccentric coupling device according to another embodiment of the present invention.

FIG. 7 is a sectional view illustrating an eccentric coupling device according to another embodiment of the present invention. The eccentric coupling device may be applied to the radial compliance scroll compressor shown in FIG. 1. In order to simplify the description thereof, the eccentric coupling device will be described in conjunction with the case in which it is applied to the radial compliance scroll compressor shown in FIG. 1. In FIG. 4, elements respectively corresponding to those in FIGS. 1 and 2, and FIGS. 4 to 6 will be designated by the same reference numerals.

As shown in FIG. 7, the eccentric coupling device includes a slide bush 12 fitted in a bearing 11 (FIG. 6) fixedly fitted in a boss 7*b* of an orbiting scroll 7. The slide bush 12 is provided with a crank pin hole 12*a*. The eccentric coupling device also includes a crank pin 10 fitted in the crank pin hole 12*a* of the slide bush 12 such that it allows a radial movement of the slide bush 12 along the crank pin hole 12*a*. The crank pin 10 is provided with an oil passage 6*a*. The eccentric coupling device further includes a cover member 120 fitted in the crank pin hole 12*a* of the slide bush 12 at an upper end portion of the crank pin hole 12*a*, and adapted to guide oil, fed through the oil passage 6*a*, to be supplied between the bearing 11 and the slide bush 12. In addition to these configurations, this eccentric coupling device further includes a separation preventing means 130 provided at an upper end of the crank pin hole 12*a*, and adapted to prevent the cover member 120 from being separated from the crank pin hole 12*a* through the upper end of the crank pin hole 12*a*, in accordance with this embodiment of the present invention.

The crank pin 10 has a length shorter than that of the slide bush 12 such that an upper end thereof is arranged at a level lower than an upper end of the slide bush 12 under the condition in which the slide bush 12 is fitted around the crank pin 10. With this structure, a space for receiving the cover member 120 is provided at the upper end portion of the crank pin hole 12*a*. The crank pin 10 is provided at an upper end of the crankshaft 6 such that it is eccentrically arranged with respect to the crankshaft 6. The oil passage 6*a* is connected to an oil passage extending throughout the crankshaft 6. The oil passage of the crankshaft 6 is also denoted by the reference numeral "6*a*".

The cover member 120 includes a body plate 122 tightly fitted in the crank pin hole 12*a* over the crank pin 10, and an oil hole 124 formed through the body plate 122 at a position corresponding to the oil passage 6*a*.

The body plate 122 serves to guide oil, fed through the oil passage 6*a*, to an upper surface thereof through the oil hole 124, while cutting off discharge of the oil through a gap defined between the crank pin 10 and the crank pin hole 12*a*.

The body plate 122 has a thickness equal to a height from the upper end of the crank pin 10 to the upper end of the slide bush 12. Preferably, the oil hole 124 has a diameter larger than that of the oil passage 6*a*.

The separation preventing means 130 comprises a separation preventing jaw 132 radially inwardly protruded from the upper end of the crank pin hole 12*a*, and adapted to be in contact with the upper surface of the cover member 120. The separation preventing jaw 132 serves to prevent the cover member 120 from rising upwardly, thereby preventing the cover member 120 from being separated from the crank pin hole 12*a*.

The body plate 122 of the cover member 120 is upwardly inserted into the crank pin hole 12*a* until the upper end thereof comes into contact with a lower surface of the separation preventing jaw 132. Thus, the body plate 122 is firmly held in the slide bush 12.

When a tilting phenomenon occurs at the slide bush 12, that is, when the slide bush 12 is inclined at one side thereof, the crank pin 10 pushes the body plate 122. In this state, the body plate 122 may be separated from the slide bush 12 unless there is a separation preventing means. In accordance with this embodiment of the present invention, however, such a separation of the body plate 122 is reliably and simply prevented because the body plate 122 is supported by the separation preventing jaw 132.

Figure 8:
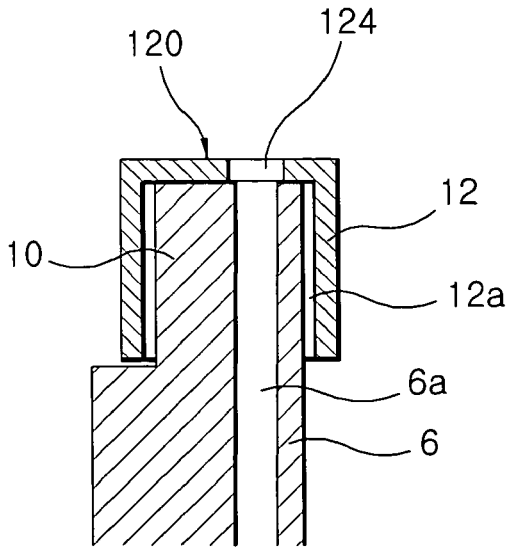
FIG. 8 is a sectional view illustrating an eccentric coupling device according to another embodiment of the present invention.

FIG. 8 is a sectional view illustrating an eccentric coupling device according to another embodiment of the present invention. The eccentric coupling device may be applied to the radial compliance scroll compressor shown in FIG. 1. In order to simplify the description thereof, the eccentric coupling device will be described in conjunction with the case in which it is applied to the radial compliance scroll compressor shown in FIG. 1. In FIG. 4, elements respectively corresponding to those in FIGS. 1 and 2, and FIGS. 4 to 6 will be designated by the same reference numerals.

As shown in FIG. 8, the eccentric coupling device includes a slide bush 12 fitted in a bearing 11 (FIG. 6) fixedly fitted in a boss 7*b* of an orbiting scroll 7. The slide bush 12 is provided with a crank pin hole 12*a*. The eccentric coupling device also includes a crank pin 10 fitted in the crank pin hole 12*a* of the slide bush 12 such that it allows a radial movement of the slide bush 12 along the crank pin hole 12*a*. The crank pin 10 is provided with an oil passage 6*a*. The eccentric coupling device further includes a cover member 120 provided at an upper end of the slide bush 12 while being integral with the slide bush 12, and adapted to close an upper end of the crank pin hole 12*a*. The cover member 120 is provided with an oil hole 124 at a position corresponding to the oil passage 6*a*.

The crank pin 10 has a length shorter than that of the slide bush 12 such that an upper end thereof is arranged at a level lower than an upper end of the slide bush 12 under the condition in which the slide bush 12 is fitted around the crank pin 10. The crank pin 10 is provided at an upper end of the crankshaft 6 such that it is eccentrically arranged with respect to the crankshaft 6. The oil passage 6*a* is connected to an oil passage extending throughout the crankshaft 6. The oil passage of the crankshaft 6 is also denoted by the reference numeral "6*a*".

The cover member 120 has a thickness equal to a height from the upper end of the crank pin 10 to the upper end of the slide bush 12. Preferably, the oil hole 124 has a diameter larger than that of the oil passage 6*a*.

The cover member 120 is formed to be integral with the slide bush 12, and provided with the oil hole 124. In accordance with this embodiment of the present invention, it is possible to sufficiently supply oil between the frictional surfaces of the bearing 11 and slide bush 12. It is also possible to simply manufacture the cover member 120. That is, since the cover member 120 is integral with the slide bush 12, the manufacture thereof can be achieved simultaneously with the manufacture of the slide bush 12. Also, a separate assembly of the cover member 120 is unnecessary.

As apparent from the above description, in accordance with the present invention, oil fed through the oil passage of the crankshaft can be sufficiently supplied between the slide bush and the bearing, that is, the frictional surfaces thereof, without being discharged through the gap defined between the crank pin and the crank pin hole. Accordingly, it is possible to minimize friction generated between the frictional surfaces, thereby achieving a smooth orbiting motion of the orbiting scroll without generation of frictional heat. Thus, an improvement in compression efficiency is achieved.

Since the separation preventing jaw is provided at the upper end of the crank pin hole formed through the slide bush, the cover member fitted in the slide bush is not separated from the slide bush even when it receives a pressure generated due to a tilting phenomenon caused by an abnormal increase in the gas pressure of the compression chambers.

Where the cover member is integral with the slide bush, it is unnecessary to perform a troublesome process of assembling the cover member to the slide bush. Thus, the assembly of the slide bush can be conveniently and simply achieved.

Although the preferred embodiments of the invention have been disclosed for illustrative purposes, those skilled in the art will appreciate that various modifications, additions and substitutions are possible, without departing from the scope and spirit of the invention as disclosed in the accompanying claims.

What is claimed is:

1. A radial compliance scroll compressor comprising:

a bush rotatably fitted in an inner surface of a boss of an orbiting scroll, and provided with a crank pin hole extending vertically throughout the bush;

a crank pin provided with cut surfaces at both sides thereof and eccentrically arranged at an upper end of a crankshaft configured to orbit the orbiting scroll, and fitted in the crank pin hole while allowing a movement of the bush in the crank pin hole, the crank pin having an oil passage communicating with an oil passage formed through the crankshaft; and a cover member provided with an oil hole therein and fitted in an upper end portion of the crank pin hole, the cover member configiured to guide oil fed through the oil passage of the crank pin such that the oil is supplied between an outer peripheral surface of the bush and an inner peripheral surface of the boss.

2. The radial compliance scroll compressor according to claim 1, wherein the cover member comprises:

a body plate tightly fitted in the crank pin hole over the crank pin; and an oil hole formed through the body plate at a position corresponding to the oil passage of the crank pin.

3. The radial compliance scroll compressor according to claim 2, wherein the body plate has a thickness equal to a height from an upper end of the crank pin to an upper end of the bush so that the body plate is in close surface contact with the upper end of the crank pin at a lower surface thereof.

4. The radial compliance scroll compressor according to claim 2, wherein the oil hole has a diameter larger than a diameter of the oil passage of the crank pin.

5. A radial compliance scroll compressor comprising:

a bush rotatably fitted in an inner surface of a boss of an orbiting scroll, and provided with a crank pin hole extending vertically throughout the bush;

a crank pin provided with cut surfaces at both sides thereof and eccentrically arranged at an upper end of a crankshaft configured to orbit the orbiting scroll, and fitted in the crank pin hole while allowing a movement of the bush in the crank pin hole, the crank pin having an oil passage communicating with an oil passage formed through the crankshaft;

a cover member provided with an oil hole and fitted in an upper end portion of the crank pin hole, the cover member configured to guide oil fed through the oil passage of the crank pin such that the oil is supplied between an outer peripheral surface of the bush and an inner peripheral surface of the boss; and a separation preventing member provided at an upper end of the crank pin hole, and configured to prevent the cover member from being separated from the crank pin hole.

6. The radial compliance scroll compressor according to claim 5, wherein the cover member comprises:

a body plate tightly fitted in the crank pin hole over the crank pin; and an oil hole formed through the body plate at a position corresponding to the oil passage of the crank pin.

7. The radial compliance scroll compressor according to claim 5, wherein the separation preventing member comprises a separation preventing jaw radially inwardly protruded from the upper end of the crank pin hole, and adapted to be in contact with the upper surface of the cover member.

8. The radial compliance scroll compressor according to claim 6, wherein the body plate has a thickness equal to a height from an upper end of the crank pin to an upper end of the bush so that the body plate is in close surface contact with the upper end of the crank pin at a lower surface thereof.

9. The radial compliance scroll compressor according to claim 6, wherein the oil hole has a diameter larger than a diameter of the oil passage of the crank pin.

10. A radial compliance scroll compressor comprising:

a bush rotatably fitted in an inner surface of a boss of an orbiting scroll, and provided with a crank pin hole extending vertically throughout the bush;

a crank pin provided with cut surfaces at both sides thereof and eccentrically arranged at an upper end of a crankshaft configured to orbit the orbiting scroll, and fitted in the crank pin hole while allowing a movement of the bush in the crank pin hole, the crank pin having an oil passage communicating with an oil passage formed through the crankshaft; and a cover member provided at an upper end of the bush while being integral with the bush, and configured to close an upper end of the crank pin hole, the cover member having an oil hole formed through the cover member at a position corresponding to the oil passage of the crank pin.

11. The radial compliance scroll compressor according to claim 10, wherein the oil hole has a diameter larger than a diameter of the oil passage of the crank pin.

12. The radial compliance scroll compressor according to claim 10, wherein the cover member has a thickness equal to a height from an upper end of the crank pin to an upper end of the bush so that the cover member is in close surface contact with the upper end of the crank pin at a lower surface thereof.

* * * * *